US006675586B2

(12) United States Patent
Maghon

(10) Patent No.: US 6,675,586 B2
(45) Date of Patent: Jan. 13, 2004

(54) HEAT SHIELD ARRANGEMENT FOR A COMPONENT CARRYING HOT GAS, IN PARTICULAR FOR STRUCTURAL PARTS OF GAS TURBINES

(75) Inventor: Hans Maghon, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/180,105

(22) Filed: Jun. 27, 2002

(65) Prior Publication Data

US 2003/0010038 A1 Jan. 16, 2003

(30) Foreign Application Priority Data

Jun. 27, 2001 (EP) ..... 01115512

(51) Int. Cl.[7] ..... F02C 7/20; F23D 14/46

(52) U.S. Cl. ..... 60/796; 60/800; 60/755; 431/243; 431/353

(58) Field of Search ..... 431/11, 158, 243, 431/353; 60/796, 800, 755, 756, 757

(56) References Cited

U.S. PATENT DOCUMENTS 2,919,549 A * 1/1960 Haworth et al. ..... 60/753
3,956,886 A * 5/1976 Sedgwick ..... 60/753
5,363,643 A 11/1994 Halila
5,413,648 A 5/1995 Salkeld
5,611,670 A 3/1997 Yoshinari
5,957,067 A * 9/1999 Dobbeling et al. ..... 110/336
6,177,200 B1 1/2001 Maloney
6,271,668 B1 8/2001 Sehdev
6,341,485 B1 * 1/2002 Liebe ..... 60/772

FOREIGN PATENT DOCUMENTS

| | | |
|---|---|---|
| EP | 0 224 817 | 11/1986 |
| EP | 0 525 545 | 7/1992 |
| EP | 1 036 850 | 6/1999 |
| EP | 1 038 982 | 3/2000 |

* cited by examiner

*Primary Examiner*—Charles G. Freay
(74) *Attorney, Agent, or Firm*—Harness, Dickey & Pierce, P.L.C.

(57) ABSTRACT

In a heat shield arrangement, in which heat shield elements are arranged next to one another on a carrying structure and are anchored to the carrying structure, there is provision for a cooling-air duct, into which cooling air is fed and which the adjacent heat shield elements communicate with one another, to be formed by at least two adjacent heat shield elements between the carrying structure and the surface of the heat shield elements which faces away from the hot gas. What is achieved thereby is that the individual heat shield elements are interconnected to form continuous cooling-air ducts, with the cooling air introduced into the cooling-air ducts being collected and being led, for example, to a burner. Advantageously, the gaps between the heat shield elements are sealed off by sealing elements.

19 Claims, 2 Drawing Sheets

HEAT SHIELD ARRANGEMENT FOR A COMPONENT CARRYING HOT GAS, IN PARTICULAR FOR STRUCTURAL PARTS OF GAS TURBINES

The present application hereby claims priority under 35 U.S.C. Section 119 on European Patent application number 01115512.4 filed Jun. 27, 2001, the entire contents of which are hereby incorporated by reference.

1. Field of the Invention

The invention generally relates to a heat shield arrangement for a component carrying hot gas. In particular, it relates to a heat shield arrangement for structural parts of gas turbines, such as, for example, a hot-gas space or a combustion chamber.

2. Background of the Invention

The arrangement includes a plurality of heat shield elements which are arranged next to one another, so as to cover the area, on a carrying structure and which are anchored to the latter.

On account of the high temperatures prevailing in hot-gas spaces, there is a need to protect a wall structure which is exposed to hot gas. For this purpose, it is possible, for example, to line the hot-gas space with heat shield elements, of which the surface facing the hot gas is cooled on the rear side.

EP 0 224 817 B1 describes a heat shield arrangement, in particular for structural parts of gas turbine plants, which is formed from a number of triangular heat shield elements. The heat shield elements are arranged next to one another on a carrying structure, so as to leave a gap in each case, and are screwed to the carrying structure.

One disadvantage of this is that hot gas from the combustion space can pass through the above-described gaps and come into contact with the carrying structure, so that the material of the carrying structure may be damaged as a result of the severe action of heat occurring during operation.

DE-U-29714742.0 illustrates a heat shield component with cooling-fluid pressure routing and a heat shield arrangement for a component carrying hot gas. The heat shield component consists of a hollow arrangement with an outer shell and a small hollow insert. Between the insert and the outer shell there is an interspace, through which the cooling fluid is capable of flowing. The insert possesses, on the bottom side, passage orifices for the cooling fluid. Closed cooling-fluid routing is achieved in that the cooling fluid flows through ducts in the carrying structure into the insert, flows from there through passage orifices into the outer shell, cooling at the same time taking place by impact cooling and convection cooling, and flows back from there through separate outlet ducts in the carrying structure. The multishell construction of the heat shield element ensures closed cooling-fluid routing. However, a multishell construction of this type is highly complicated.

SUMMARY OF THE INVENTION

An object of an embodiment of the invention includes specifying a heat shield arrangement for a structure carrying hot gas. Preferably, the structure can include a metallic structural part of a gas turbine plant or combustion chamber, with heat shield elements anchored next to one another, so as to cover the area, on a carrying structure. In particular, the heat shield arrangement overcomes the disadvantages described, can be used in a flexible way, can easily be produced and can be configured in a simple way in terms of design.

An object may be achieved, according to an embodiment of the invention, by a heat shield arrangement for a structure carrying hot gas, in particular a metallic structural part of a gas turbine plant or combustion chamber, with heat shield elements anchored next to one another, so as to cover the area, on a carrying structure. Preferably, it is formed by at least in each case two adjacent heat shield elements between the carrying structure and in each case the surface of the heat shield elements which faces away from the hot gas, a cooling-air duct, into which cooling air is fed and by which the adjacent heat shield elements communicate with one another.

By virtue of the arrangement according to an embodiment of the invention, it is possible, for example, to implement closed air cooling of a combustion chamber, in that compressor output air is fed into the cooling-air duct formed according to an embodiment of the invention. In the cooling-air duct, the cooling air is collected and, after cooling has taken place, is delivered to the at least one burner, so that it is available for the combustion process.

Advantageously, the at least two adjacent heat shield elements are connected by at least one sealing element, so that the emergence of cooling air from the cooling-air duct into the structure carrying hot gas and/or the entry of hot gas into the cooling-air duct are prevented.

As a result of the thermal movements of the heat shield elements which occur during operation, the latter are usually anchored to the carrying structure so as to leave gaps between the individual heat shield elements, so that the heat shield elements can expand under the action of heat.

The result of leaving gaps between the heat shield elements, however, is that, on the one hand, the cooling air flowing into the cooling-air duct formed according to the invention by at least two adjacent heat shield elements may emerge from the cooling-air duct through at least one gap and enter the combustion chamber, so that this fraction of air (leakage-air stream) is lost for combustion purposes. Furthermore, hot gas may flow in the opposite direction out of the combustion chamber into the cooling-air duct, so that, on the one hand, this hot-gas stream is lost for the purpose of subsequent conversion into mechanical and/or electrical energy and, on the other hand, the cooling potential of the cooling air in the cooling-air duct is reduced, because this cooling air is heated by the leakage streams of hot gas flowing out of the hot-gas space into the cooling-air duct. Consequently, according to an embodiment of the invention, there is provision for the at least two adjacent heat shield elements to be connected by a sealing element. The seal is preferably flexible, so that thermal movements of the heat shield elements do not damage the sealing element.

In an advantageous refinement of the invention, the heat shield elements are designed essentially as plates, in particular as metallic plates, which each have a web in each case at least two opposite edges.

Webs of this type, on the one hand, improve the stability of the heat shield elements, in that they act as stiffening ribs, and, on the other hand, afford a good possibility for mounting the sealing element. Furthermore, the cross section of the cooling-air duct can be set or predetermined by the height of the web, in that the webs of the adjacent heat shield elements form a side wall of the cooling-air duct. Moreover, the stiffening properties of the webs can be fixed by the choice of their geometry, for example of the rib height. In this way, for example, the thermal stresses which occur can be managed effectively.

In an advantageous refinement of the invention, the adjacent heat shield elements are contiguous to one another in each case with one web, and the at least one, in particular U-shaped sealing element can be introduced in each case into a groove of the respective web of the adjacent heat shield elements.

In this refinement of the invention, the mutually contiguous webs of the adjacent heat shield elements point, for example, toward the combustion chamber or preferably toward the carrying structure. The webs each have a groove, in particular a slot in their foot surface, so that the sealing element, which connects the adjacent heat shield elements to one another, can be introduced into the grooves of the webs of the adjacent heat shield elements.

A groove is particularly easy to produce and with the aid of which a connection can be made, in the present exemplary embodiment, between the adjacent heat shield elements. The sealing element is preferably U-shaped, so that, for example, it is flexible under thermal expansion forces acting on the two legs of the U-shaped sealing element and allows these thermal expansion forces, without the sealing element being destroyed. In order to connect the preferably U-shaped sealing element to the adjacent heat shield elements particularly easily, webs of the heat shield elements which point either toward the combustion chamber or preferably toward the carrying structure are particularly suitable. Thus, it is possible, in a particularly simple way, to introduce an, in particular, U-shaped sealing element with its two legs in each case into a groove of the respective web of the adjacent heat shield elements, implement a good sealing action and produce a seal which is insensitive to destruction with respect to thermal expansion forces.

According to a further advantageous refinement of the invention, further at least two adjacent heat shield elements which do not communicate with one another by means of a cooling-air duct are connected by means of at least one further sealing element.

In this advantageous refinement of the invention, for example, a plurality of separate cooling-air ducts are formed by heat shield elements, heat shield elements being contiguous, that is to say adjacent, to one another and contributing in each case to the formation of a separate cooling-air duct, so that these further at least two adjacent heat shield elements do not form a (common) cooling-air duct and therefore do not communicate with one another by means of a cooling-air duct.

A heat shield element of the further at least two adjacent heat shield elements may in this case be identical to a heat shield element of the in each case two adjacent heat shield elements described above.

So that the hot gas formed in the combustion chamber cannot lead to the carrying structure being destroyed, in that said hot gas passes through a gap between the further at least two adjacent heat shield elements and attacks the carrying structure, the further sealing element is provided for the protection of the carrying structure.

Preferably, the further at least two adjacent heat shield elements are contiguous to one another in each case with one web, and the webs lie on the further, preferably planar sealing element, so that an attack of the hot gas on the carrying structure is prevented.

In this exemplary embodiment, the webs point either toward the combustion chamber or preferably toward the carrying structure. Furthermore, the mutually contiguous webs of the further at least two adjacent heat shield elements in each case form a side wall of a cooling-air duct, said side walls belonging to different cooling-air ducts.

So that thermal expansion of the heat shield elements during operation is possible, the heat shield elements are usually anchored to the carrying structure so as to leave a gap. Hot gas may pass through this gap out of the combustion space and between the heat shield elements and thus attack the carrying structure.

It has already been illustrated that the gap between two adjacent heat shield elements which form a cooling-air duct is sealed off preferably by means of a sealing element, in particular a U-shaped sealing element, in order to protect the carrying structure. The same problem of a possible attack of hot gas on the carrying structure also arises with regard to the further at least two adjacent heat shield elements which do not form a common cooling-air duct. The last-mentioned heat shield elements are preferably contiguous to one another with webs which, as already mentioned, at the same time in each case form a side wall of a cooling-air duct and therefore mostly have a markedly greater web height than those webs with which adjacent heat shield elements forming a (common) cooling-air duct are contiguous to one another. If, then, the webs of the further adjacent heat shield elements were to lie directly on the carrying structure, hot gas from the combustion chamber could enter the gap between the further adjacent heat shield elements and attack the carrying structure. Consequently, in the present embodiment of the invention, there is provision for the webs of the further at least two adjacent heat shield elements not to lie directly on the carrying structure, but on the further, preferably planar sealing element, so that an attack of the hot gas on the carrying structure is prevented. The further sealing element may be covered with a heat insulation layer in order to increase its thermal resistance.

This ensures that hot gas from the combustion chamber cannot impinge directly onto the carrying structure, but is retained by the further sealing element. The further sealing element itself is usually connected exchangeably to the carrying structure, so that, in the event of a repair, it can be removed, and it preferably consists of a high-temperature material.

Particularly advantageously, a heat insulation layer is applied to those surfaces of the heat shield elements which face the hot gas.

This heat insulation layer protects the heat shield elements against overstressing and/or destruction by the action of heat caused by the hot gas. Furthermore, said heat insulation layer assists the cooling of the heat shield elements, in that, by virtue of its insulating action, it keeps part of the heat away from the heat shield element. Thus, for example, the throughput of cooling air necessary for cooling the heat shield elements is reduced.

It is particularly advantageous if the heat shield elements each have a preferably centrally arranged screwing device, by means of which the heat shield elements can be anchored to the carrying structure.

Thus, the heat shield elements can in a simple way be released from the carrying structure or connected to the latter, in that, preferably, in each case a single screw connection is released or produced. The outlay in terms of production and of release of a heat shield arrangement according to the invention is thereby very low.

BRIEF DESCRIPTION OF THE DRAWINGS

An exemplary embodiment of the invention is illustrated in more detail below.

In the drawings.

Elements corresponding to one another in the figures are given the same reference symbols.

DETAILED DESCRIPTION OF THE PREFERRED EMBODIMENTS

Figure 2:
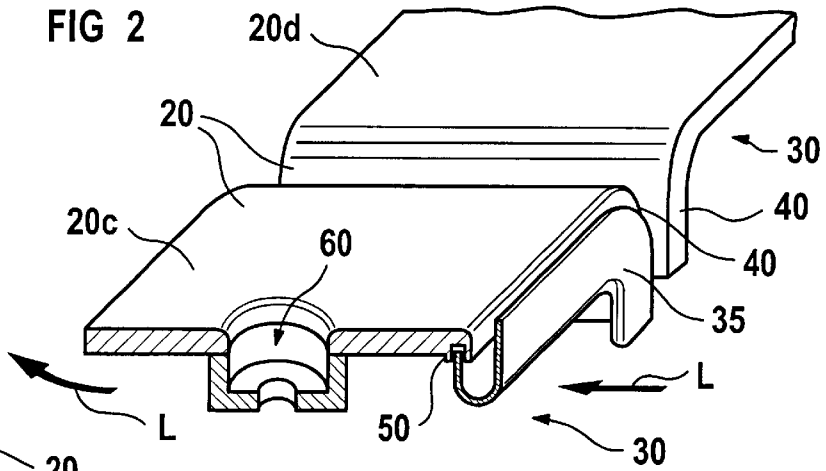
FIGS. 1 and 2 show a carrying structure with a heat shield arrangement according to an embodiment of the invention including heat shield elements arranged next to one another (FIG. 1) and one behind the other (FIG. 2), and FIGS. 3 and 4 in each case show an exemplary embodiment for sealing off between adjacent heat shield elements, which communicate with one another via a common cooling-air duct (FIG. 3), and for adjacent heat shield elements, which do not communicate with one another via a common cooling-air duct (FIG. 4), for use in a heat shield arrangement according to an embodiment of the invention.
Figure 1:
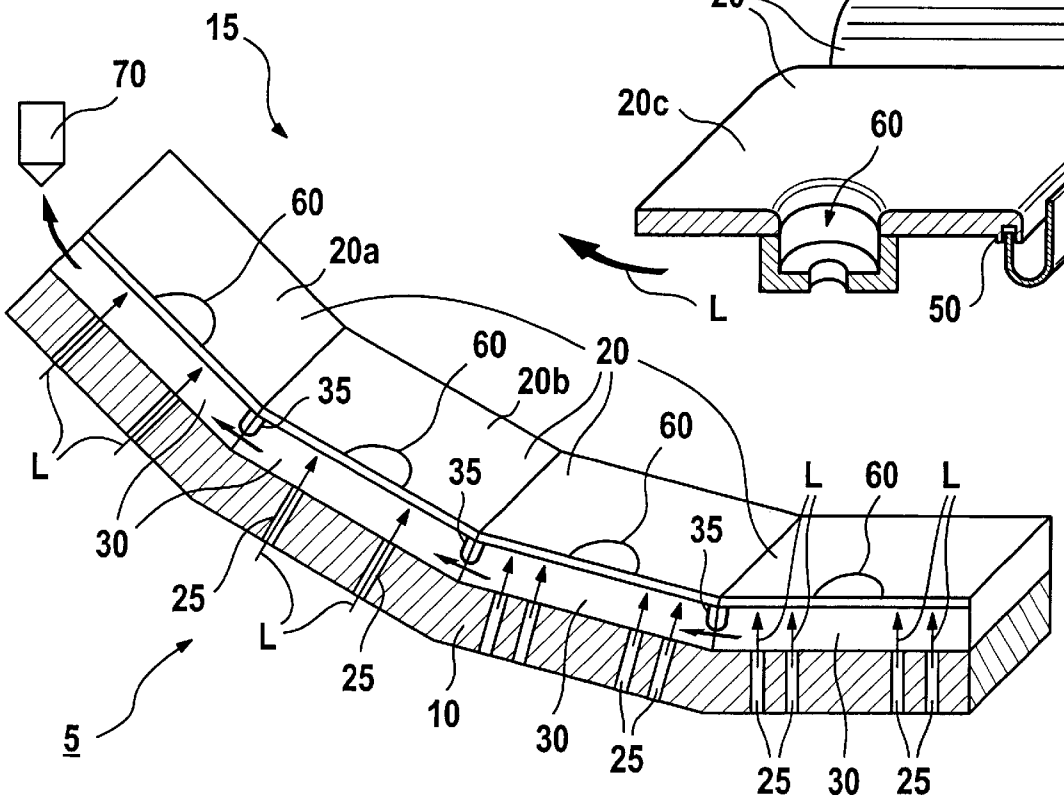

FIG. 1 illustrates a heat shield arrangement 5 according to the invention, in which heat shield elements 20 are arranged next to one another, so as to cover the area, on a carrying structure 10; FIG. 2 shows a cross section through a heat shield element and the carrying structure, said cross section dividing the heat shield elements approximately in half. Conventionally, for example for lining a relatively large hot-gas space, such as, for example, a combustion chamber 15, a plurality of rows of heat shield elements are arranged contiguously to one another on a carrying structure 10 (this is indicated in FIG. 2).

The heat shield arrangement 5 may, for example, line a combustion chamber 15 of a gas turbine, in order to prevent the carrying structure 10 from being damaged while the gas turbine is in operation.

In order to reduce the thermal loads, there is provision for cooling the heat shield elements 20 by means of cooling air in each case on their surface facing away from the combustion chamber 15.

At least two adjacent heat shield elements 20*a*, 20*b* form a cooling-air duct 30 between the carrying structure 10 and in each case the surface of the heat shield elements 20*a*, 20*b* which faces away from the hot gas. The two adjacent heat shield elements 20*a*, 20*b* mentioned thereby communicate, for example, via the cooling-air stream L which flows directly from one of the adjacent heat shield elements to the other in the common cooling-air duct 30 formed by the adjacent heat shield elements.

The present FIG. 1 illustrates, as an example, four heat shield elements 20 which form a common cooling-air duct 30. However, a markedly larger number of heat shield elements, which may also be arranged in a plurality of rows, also come under consideration (indicated in FIG. 2).

The cooling air L, which is fed into the cooling-air duct 30 through orifices 25, cools the heat shield elements 20 on the rear side. For example, this is done by impact cooling, the cooling air L impinging virtually perpendicularly onto the surface of the heat shield elements 20 which faces away from the hot gas and thereby being capable of absorbing and discharging thermal energy. The cooling of the heat shield elements may take place, furthermore, by means of convection cooling, in which case cooling air L sweeps along the rear side of the heat shield elements essentially parallel to the surface of the latter and can thereby likewise absorb and discharge thermal energy.

In the present exemplary embodiment, the cooling air L moves as a cooling-air stream, for the most part, from right to left in the cooling-air duct 30 formed jointly by the heat shield elements 20 and can be supplied to a burner 70, which is located, for example, in the combustion chamber 15, in order to be utilized for combustion.

In order to prevent an emergence of the cooling air L from the cooling-air duct 30 directly into the combustion chamber 15 and an entry of hot gas from the combustion chamber 15 into the cooling-air duct 30, sealing elements 35 are provided between the heat shield elements 20. In this respect, FIG. 2 shows a possible configuration of the sealing element 35 in a cross-sectional illustration through a heat shield element. Said sealing element may be introduced, for example, into a groove 50 of a web 40 of a heat shield element, the connection to an adjacent heat shield element by which a common cooling-air duct is formed being made in a similar way, in that, preferably, the other leg of the advantageously U-shaped sealing element 35 is introduced into the groove 50 of a web 40 of an adjacent heat shield element.

FIG. 2 illustrates, moreover, a screwing device 60, for example a countersink for receiving a screw. Advantageously, to anchor the heat shield element 20 to the carrying structure 10, a fastening element, for example a screw, is introduced into the screwing device 60 and is fastened to sides of the carrying structure 10, for example, by a nut.

Figure 3:
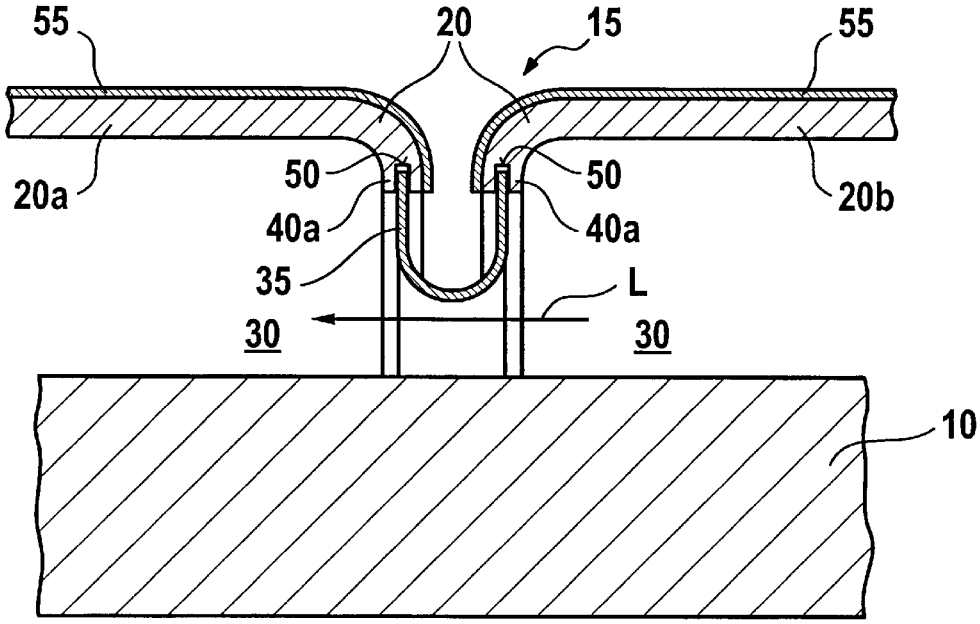
Figure 4:
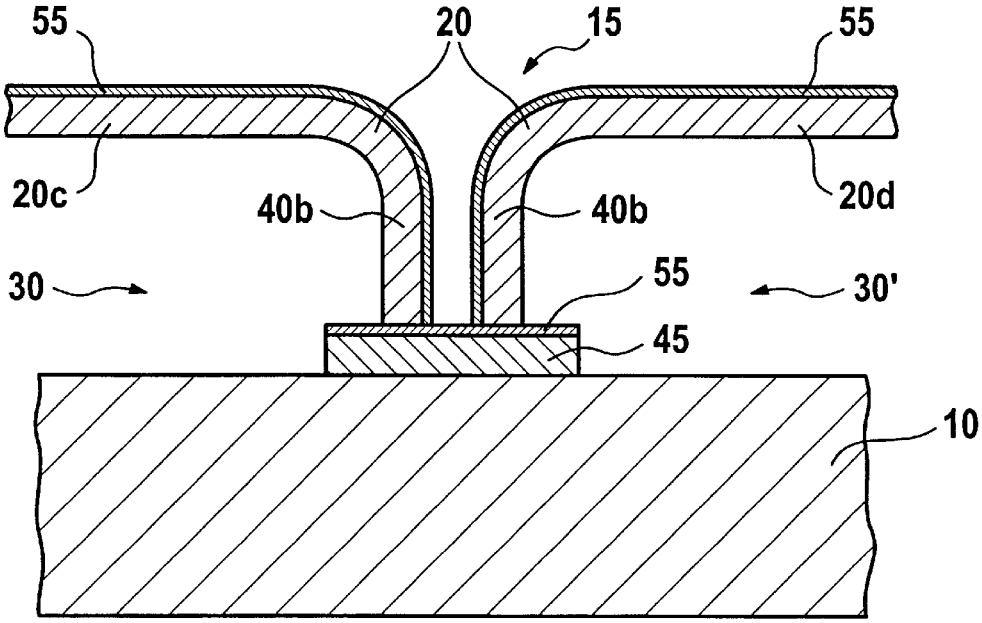

FIG. 3 and FIG. 4 illustrate in each case an exemplary embodiment of the seal between adjacent heat shield elements 20*a*, 20*b* and 20*c*, 20*d*.

In this case, FIG. 3 shows the seal between adjacent heat shield elements 20*a*, 20*b* which, according to an embodiment of the invention, form a cooling-air duct 30, via which the heat shield elements communicate with one another, for example, by means of cooling air L.

The heat shield elements 20*a*, 20*b* each have, at least at two of their opposite edges, in each case a web 40*a*, into each of which a groove 50 is introduced.

In each case a leg of the sealing element 35 of essentially U-shaped cross section is introduced into these grooves 50, so that the entry of hot gas from the combustion chamber 15 into the gap between the heat shield elements 20*a*, 20*b* is prevented. An exemplary embodiment of a more detailed figurative configuration of the sealing element 35 may be gathered from FIG. 2.

FIG. 4 illustrates further two adjacent heat shield elements 20*c*, 20*d* which do not form a cooling-air duct via which they communicate with one another. The heat shield element 20*c* forms, for example, at least together with another heat shield element not illustrated, a common cooling-air duct 30, and the heat shield element 20*b* forms, with at least one further other heat shield element, not illustrated, a common cooling-air duct 30'. Mutually contiguous heat shield elements of this type, illustrated in FIG. 4, which do not form a common cooling-air duct, are obtained, for example, when the row of heat shield elements which is illustrated in FIG. 1 is multiplied and is arranged on a carrying structure "one behind the other", as indicated in FIG. 2.

In FIG. 4, to protect the carrying structure 10 against hot gas emerging from the combustion chamber 15 into the gap between the heat shield elements 20*c*, 20*d*, a sealing element 45 is provided, which is preferably designed as a plate connected to the carrying structure 10. The heat shield elements 20*c*, 20*d* have, at least in each case on two opposite sides of their surface facing the hot gas, webs 40*b* which particularly advantageously have a web height which exceeds the web height of the webs 40*a* illustrated in FIG. 3. The webs 40*b* in this case form side walls of the cooling-air ducts 30, 30'. The seal is produced in that the webs 40*b* lie on the sealing element 40, so that an attack of the hot gas from the combustion chamber 15 on the carrying structure 10 is prevented. Preferably, the sealing element 45 extends over the entire length of the web 40*b*. Furthermore, the sealing element 45 and the heat shield elements 20 may be covered with a heat insulation layer 55.

| List of reference symbols | |
|---|---|
| 5 | Heat shield arrangement |
| 10 | Carrying structure |
| 15 | Combustion chamber |
| 20, 20a, b, c, d | Heat shield elements |
| L | Cooling air |
| 25 | Orifices |
| 30, 30' | Cooling-air duct |
| 35, 45 | Sealing element |
| 40a, b | Web |
| 50 | Groove |
| 55 | Heat insulation layer |
| 60 | Screwing device |
| 70 | Burner |

The invention being thus described, it will be obvious that the same may be varied in many ways. Such variations are not to be regarded as a departure from the spirit and scope of the invention, and all such modifications as would be obvious to one skilled in, the art are intended to be included within the scope of the following claims.

What is claimed is:

1. A heat shield arrangement for a structure carrying hot gas, comprising:

a plurality of heat shield elements anchored next to one another on a carrying structure, wherein a cooling-air duct, into which cooling air is fed and by which the adjacent heat shield elements communicate with one another, is formed by at least two adjacent heat shield elements between the carrying structure and the surface of the heat shield elements which faces away from the hot gas, and wherein the heat shield elements each have a centrally arranged screwing device, by which the heat shield elements are anchorable to the carrying structure.

2. The heat shield arrangement as claimed in claim 1, wherein the at least two adjacent heat shield elements are connected by at least one sealing element, so that at least one of the emergence of cooling air from the cooling-air duct into the structure carrying hot gas and the entry of hot gas into the cooling-air duct, are prevented.

3. The heat shield arrangement as claimed in claim 2, wherein the heat shield elements are designed essentially as plates which each have a web on at least at two opposite edges.

4. The heat shield arrangement as claimed in claim 3, wherein further, at least two adjacent heat shield elements which do not communicate with one another by a cooling-air duct are connected by at least one further sealing element.

5. The heat shield arrangement as claimed in claim 4, wherein the further at least two adjacent heat shield elements are contiguous to one another with one web, and wherein the webs lie on the further sealing element, so that an attack of the hot gas on the carrying structure is prevented.

6. The heat shield arrangement as claimed in claim 1, wherein a heat insulation layer is applied to those surfaces of the heat shield elements which face the hot gas.

7. The heat shield arrangement as claimed in claim 1, wherein the carrying structure is a metallic structural part of at least one of a gas turbine plant and a combustion chamber.

8. The heat shield arrangement as claimed in claim 1, wherein a plurality of heat shield elements are anchored next to one another on a carrying structure so as to cover the area.

9. The heat shield arrangement as claimed in claim 3, wherein the heat shield elements are designed essentially as metallic plates.

10. The heat shield arrangement as claimed in claim 2, wherein a heat insulation layer is applied to those surfaces of the heat shield elements which face the hot gas.

11. The heat shield arrangement as claimed in claim 3, wherein a heat insulation layer is applied to those surfaces of the heat shield elements which face the hot gas.

12. The heat shield arrangement as claimed in claim 4, wherein a heat insulation layer is applied to those surfaces of the heat shield elements which face the hot gas.

13. A heat shield arrangement for a structure carrying hot gas, comprising:

a plurality of heat shield elements anchored next to one another on a carrying structure, wherein a cooling-air duct, into which cooling air is fed and by which the adjacent heat shield elements communicate with one another, is formed by at least two adjacent heat shield elements between the carrying structure and the surface of the heat shield elements which faces away from the hot gas, wherein the at least two adjacent heat shield elements are connected by at least one sealing element so that at least one of the emergence of cooling air from the cooling-air duct into the structure carrying hot gas and the entry of hot gas into the cooling-air duct are prevented, wherein the heat shield elements are designed essentially as plates which each have a web on at least at two opposite edges, and wherein the at least two adjacent heat shield elements are contiguous to one another with one web, and the at least one sealing element is introduceable into a groove of the respective web of the adjacent heat shield elements.

14. The heat shield arrangement as claimed in claim 13, wherein the sealing element is a U-shaped sealing element.

15. The heat shield arrangement as claimed in claim 13, wherein a heat insulation layer is applied to those surfaces of the heat shield elements which face the hot gas.

16. The heat shield arrangement as claimed in claim 13, wherein the heat shield elements each have a centrally arranged screwing device, by which the heat shield elements are anchorable to the carrying structure.

17. A heat shield arrangement for a structure carrying hot gas, comprising:

a plurality of heat shield elements anchored next to one another on a carrying structure, wherein a cooling-air duct, into which cooling air is fed and by which the adjacent heat shield elements communicate with one another, is formed by at least two adjacent heat shield elements between the carrying structure and the surface of the heat shield elements which faces away from the hot gas, wherein the at least two adjacent heat shield elements are connected by at least one sealing element so that at least one of the emergence of cooling air from the cooling-air duct into the structure carrying hot gas and the entry of hot gas into the cooling-air duct are prevented, wherein the heat shield elements are designed essentially as plates which each have a web on at least at two opposite edges, wherein further, at least two adjacent heat shield elements which do not communicate with one another by a cooling-air duct are connected by at least one further sealing element, wherein the further at least two adjacent heat shield elements are contiguous to one another with one web, wherein the webs lie on the further sealing element, so that an attack of the hot gas on the carrying structure is prevented and wherein the sealing element is a planar sealing element.

18. The heat shield arrangement as claimed in claim 17, wherein the heat shield elements each have a centrally arranged screwing device, by which the heat shield elements are anchorable to the carrying structure.

19. A heat shield arrangement for a structure carrying hot gas, comprising:

a plurality of heat shielding means for shielding heat, anchored next to one another on a carrying structure, wherein a cooling-air duct, into which cooling air is fed and by which the adjacent heat shielding means communicate with one another, is formed by at least two adjacent heat shielding means between the carrying structure and the surface of the heat shielding means which faces away from the hot gas, and wherein the heat shielding means each include a centrally arranged screwing means for anchoring the heat shielding means to the carrying structure.

* * * * *